United States Patent [19]

Zylbert

[11] Patent Number: 4,559,886

[45] Date of Patent: Dec. 24, 1985

[54] THREAD GUIDE CONSTRUCTION

[75] Inventor: Thaddeus J. Zylbert, Morris Plains, N.J.

[73] Assignee: The Singer Company, Stamford, Conn.

[21] Appl. No.: 669,715

[22] Filed: Nov. 9, 1984

[51] Int. Cl.[4] ..... B65H 57/00; B65H 59/12

[52] U.S. Cl. ..... 112/302; 242/153; 242/157 R

[58] Field of Search ..... 112/302, 270; 57/352, 57/355, 356, 357; 242/157 R, 153; 66/125 R

[56] References Cited

U.S. PATENT DOCUMENTS 1,956,338 4/1934 Bartling .

2,323,987 7/1943 Foster ..... 242/157 R 3,278,137 11/1966 Hartley .

3,552,678 1/1971 Du Ross .

3,713,605 1/1973 Vahle et al. .

3,787,229 1/1974 Rudness ..... 242/157 R 4,427,165 1/1984 Larsen et al. .

*Primary Examiner*—Werner H. Schroeder

*Assistant Examiner*—Joseph S. Machuga

*Attorney, Agent, or Firm*—William V. Ebs; Robert E. Smith; Edward L. Bell

[57] ABSTRACT

A sewing machine thread guide is provided with a flexible plastic thread entrapping core portion, and a hard core encasing portion having thread supporting grooves in alignment with thread receiving eyelets in the core portion.

7 Claims, 7 Drawing Figures

THREAD GUIDE CONSTRUCTION

BACKGROUND OF THE INVENTION

1. Field of the Invention

The invention relates to self threading thread guides for sewing machines.

2. Description of the Prior Art

Self threading thread guides of the type wherein thread can be introduced easily through an open mouth at the top of the guide, and which are formed so as to entrap the thread after having been introduced may be seen for example in U.S. Pat. No. 3,713,605, for "Quick Threading Thread Guide for Sewing Machines" of Erwin Vahle et al, issued Jan. 30, 1973, and U.S. Pat. No. 4,427,165, for "Sewing Machine Thread Guide with Protective Guard" of Robert H. Larsen et al, issued Jan. 24, 1984. Such a thread guide has generally been constructed of a flexible plastic material so as to be capable of deflecting when thread is introduced into the guide, and of assuming its original shape after insertion of the thread. However, materials meeting this requirement generally exhibit little resistance to thread wear.

It is a prime object of the present invention to provide an improved self threading sewing machine thread guide which is resistant to thread wear and abrasive damage.

It is another object of the invention to provide a thread guide with a resilient plastic thread entrapping portion, and with a rigid portion which is resistant to thread wear and which by helping to guide the thread is effective to prevent the softer flexible material from being subjected to undue wear.

Other objects and advantages of the invention will become apparent during a reading of the specification taken in connection with the accompanying drawings.

SUMMARY OF THE INVENTION

A sewing machine thread guide according to the invention includes a core portion of a resilient plastic material and a rigid core embracing portion which is more resistant to thread wear than the core portion. The core portion includes a thread entrapping passageway with an upper diverging thread receiving notch, and the rigid embracing portion includes thread guiding grooves communciating with the thread entrapping passageway in the core portion.

DESCRIPTION OF THE INVENTION

Figure 1:
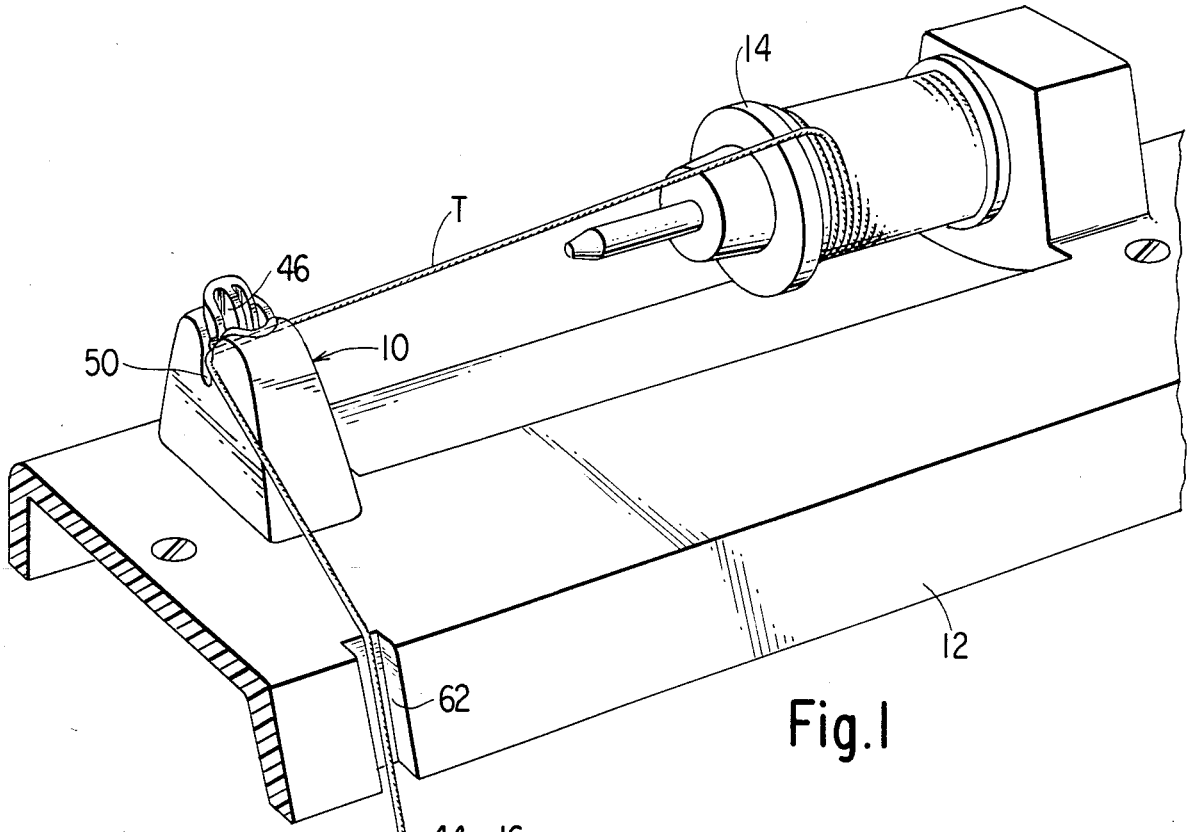
FIG. 1 is a fragmentary perspective view showing a thread guide according to the invention on the top cover of a sewing machine.
Figure 3:
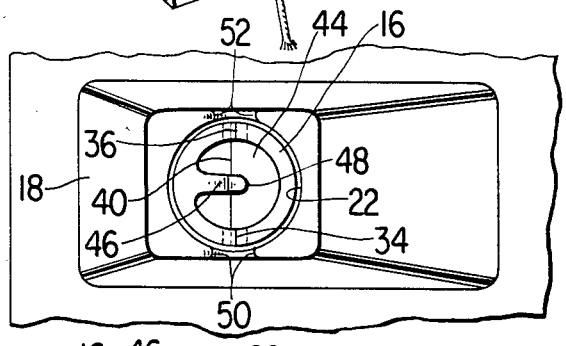
FIG. 3 is a top view of the thread guide.

Referring to FIG. 1 of the drawings, there may be seen a thread guide 10 according to the invention on the top cover 12 of a sewing machine with thread T extending to the guide from a spool 14. The thread guide (see FIGS. 2 through 5) includes a thread entrapping core portion 16 and a core embracing portion 18. As shown, core portion 16 has an outer cylindrical configuration for the major part of its length, but includes a base 20 having a rectangular outline. Core embracing portion 18 includes a cylindrical hole 22 wherein the cylindrical part of core portion 16 is located, and a rectangular cavity 24 in which base 20 is situated. Hole 22 is formed to loosely accommodate cylindrical part 18 of core portion 16 thus providing space to accommodate expansion of the core portion. Base 20, however, is more tightly received in cavity 24, and is cemented therein with a suitable adhesive.

Core portion 16 of the thread guide projects slightly above the upper end of core embracing portion 18 and is formed thereat with a diverging thread receiving notch 26. Inclined surfaces of notch 26 intersect substantially at the vertical diametrical plane of aligned round thread guiding eyelets 30 and 32 which communciate with the notch by way of slits 34 and 36, respectively finer than the diameter of any thread intended to be used with the thread guide and extending each slit from one of the eyelets 30, 32 toward the upper end of the core portion 16 where the notch 26 is located. Beneath the eyelets 30 and 32, core portion 16 is provided with an elongated aperture 37 having an upper extremity 38 extending laterally to one side of the vertical centerline of the thread guiding eyelets and communicating with the eyelets 30 and 32 through a slit 40 finer than the diameter of any thread intended to be used with the thread guiding and extending toward the eyelets 30 and 32 in the upper end of the core portion. Formed centrally in core portion 16 between and connecting with eyelets 30 and 32 is a recess 44 which communicates by way of slit 40 with aperture 37. A thread deflecting fin 46 extends transversely into recess 44 to cause thread which is directed through eyelets 30 and 32 to curve about the free edge 48 of the fin.

Core embracing portion 18 of thread guide 10 includes top thread supporting grooves 50 and 52 in positions of alignment with eyelets 30 and 32. Portion 18 further includes a threaded hole 54 in base 20 for a screw 56 with which the thread guide is attached to sewing machine cover 12. A depending pin 58 at the bottom of core embracing portion 18 of the thread guide is received in a hole 60 in cover 12 to prevent the thread guide from turning.

Figure 4:
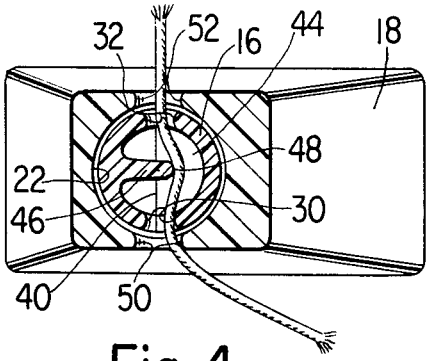
FIG. 4 is a sectional view taken on the plane of the line 4—4 of FIG. 2.
Figure 2:
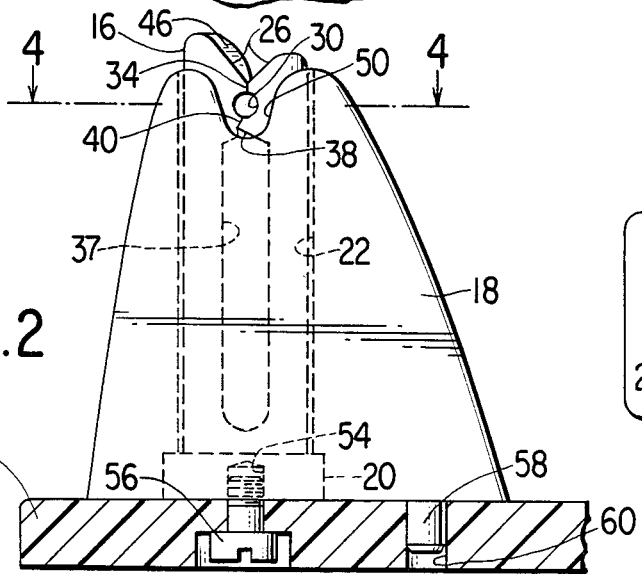
FIG. 2 is a side elevational view of the thread guide.
Figure 5:
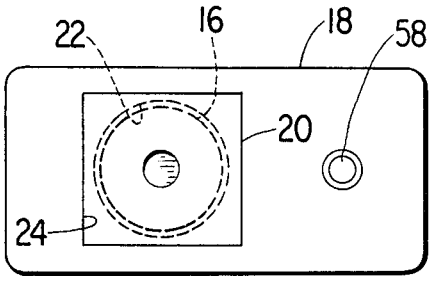
FIG. 5 is a bottom view of the thread guide.
Figure 6:
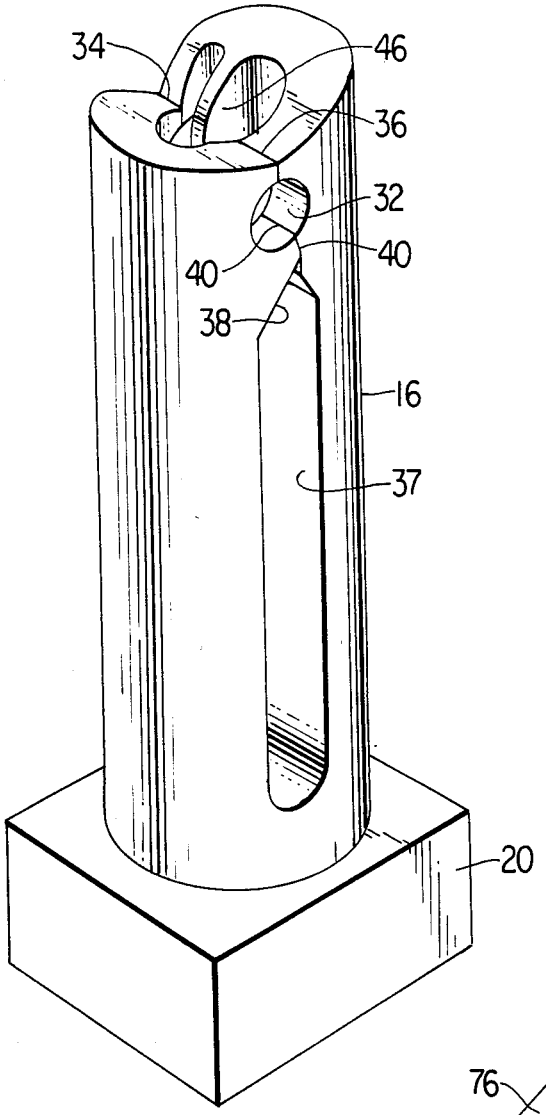
FIG. 6 is a perspective view of the core of the thread guide.

Core portion 16 of thread guide 10 is of a resilient plastic material such as "Delrin", and when thread is pulled downwardly in notch 26, slits 34 and 36 are temporarily forced open the resulting expansion of the core portion being accommodated by the loose fit thereof in the hole 22 of the core embracing portion 18 thus to admit the thread to a thread entrapping passageway including the eyelets 30 and 32, and recess 44. Once the thread is in the eyelets, tension applied to the thread while it is adjacent slits 34, 36 or 40, does not give rise to a force resolution tending to open the slits because of the circular conformation of the eyelets. Because slit 40 is laterally offset from the vertical centerline of the eyelets where the thread is located most prevelently, passage of the thread through slit 40 is further discouraged. Unthreading of the eyelets is also further discouraged by the thread deflecting fin 46 which forces the thread to assume a path through the eyelets which as illustrated in FIG. 4 is out of line with slits 34, 36, and 40.

The core embracing portion 18 of the thread guide is a rigid member which is more resistant to thread wear than core portion 16. Such core embracing portion may be of a hard wear resistant material such as steel, or of a less expensive, less wear resistant material, (as for example, a plastic or phenolic material, or zinc) having thereon a hard surface coating of a material such as chromium.

Thread guide 10, as shown on sewing machine cover 12 in FIG. 1, serves to alter the directional path of thread extending from spool 14 to a slot 62 as on the way to thread tensioning and takeup mechanism (not shown). In the absence of core encasing portion 18 of the thread guide, the thread would cut grooves into the plastic material of the core portion 16 at eyelet 30 on the thread exiting side of the guide. However, the thread is supported in groove 50 of core encasing portion 18 and is thereby prevented from damaging the plastic material. Because the directional path in FIG. 1 of thread entering the thread guide 10 is substantially in line with eyelet 32, there is little tendency for the thread to wear grooves into eyelet 32. In the event the thread guide were disposed differently with respect to the spool from that shown in FIG. 1 and such tendency existed, damage to eyelet 32 would be prevented by support lended to the thread by groove 52 in core encasing portion 18 to the guide.

Figure 7:
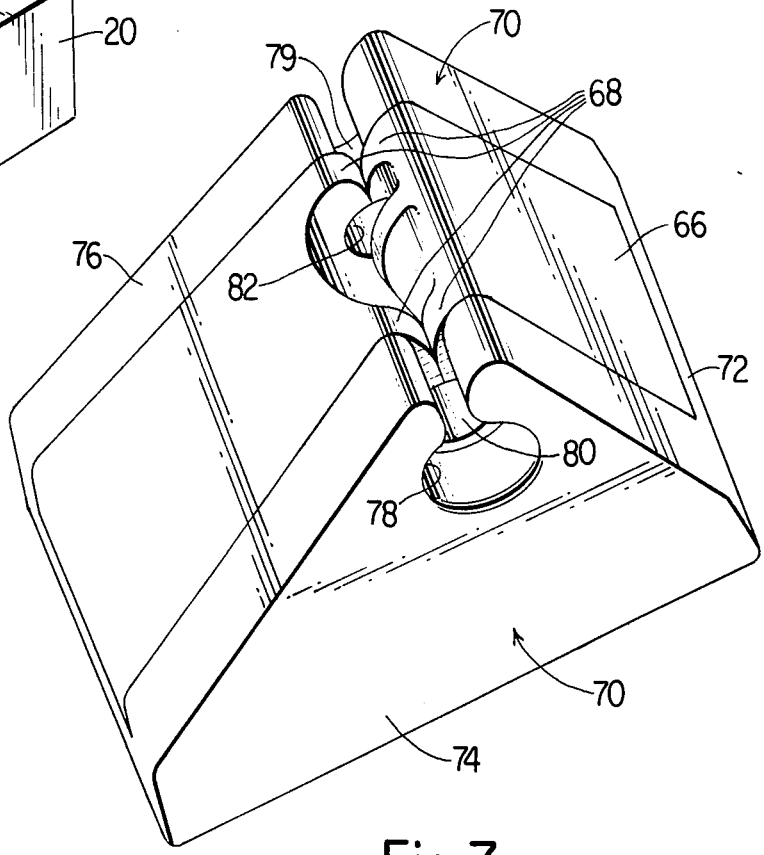
FIG. 7 is a perspective view of a modified form of thread guide according to the invention.

A modified form of thread guide 64 according to the invention may be seen in FIG. 7. Such thread guide includes a resilient plastic core portion 66 which is triangularly configured but is otherwise generally similar to the core portion 16 of thread guide 10, and as such is formed to receive thread into a thread entrapping passageway by way of a V-shaped notch 68. The guide further includes a rigid wear resistant core embracing portion 70 with a base 72 and, upstanding triangularly shaped sides 74 and 76 that are integral with the base. The base 72 is cemented or otherwise suitably secured to core portion 66, and sides 74 and 76 extend upwardly into contact with thread entering and thread exiting sides thereof. Core portion 66 is free to spread in a direction perpendicular to the directional path for thread through the device as required to accommodate the downward movement of thread into the device. A groove 78 in side 74 and a like groove 79 in side 76 are provided to support thread extending through eyelets 80 and 82, respectively in core portion 66, and prevent damage thereto in the manner described for the device of FIGS. 1 through 6.

It is to be understood that the present disclosure relates to preferred embodiments of the invention which are for purposes of illustration only, and are not to be construed as limiting the invention. Numerous alterations and modifications of the structures herein disclosed will suggest themselves to those skilled in the art and all such modifications and all such alterations which do not depart from the spirit and scope of the invention are intended to be included within the scope of the appended claims.

I claim:

1. A guide for sewing thread extending from a supply spool on a sewing machine, the guide comprising a core portion of a resilient plastic material having an outer portion of generally cylindrical configuration for at least a substantial portion of the length thereof and a rigid core embracing portion which is more resistant to thread wear than the core portion, said core embracing portion being formed with a cylindrical hole wherein the cylindrical portion of the core portion is received, said core portion including a thread entrapping passageway with an upper diverging thread receiving notch, and said core embracing portion including thread guiding grooves communicating with the thread entrapping passageway in the core portion.

2. A guide for sewing thread according to claim 1 wherein the core portion projects beyond the upper end of the rigid core embracing portion.

3. A guide for sewing thread according to claim 2 wherein the core portion includes a base which is cemented to the rigid core embracing portion.

4. A guide according to claim 1 wherein the core portion is slit toward the upper end to enable the expansion thereof and admittance of thread to the thread entrapping passage, said core embracing portion being formed to accommodate the expansion of the core portion.

5. A guide according to claim 1 wherein the core embracing portion is a metallic member.

6. A guide according to claim 1 wherein the core embracing portion is a chromium plated plastic member.

7. A guide according to claim 1 wherein the core embracing portion is a chromium plated zinc member.

* * * * *